US006526717B2

(12) United States Patent
Waggoner et al.

(10) Patent No.: US 6,526,717 B2
(45) **Date of Patent: *Mar. 4, 2003**

(54) UNITARY MODULAR SHAKE-SIDING PANELS, AND METHODS FOR MAKING AND USING SUCH SHAKE-SIDING PANELS

(75) Inventors: Kurt Waggoner, Kingston, WA (US); Scott Fladgard, Kingston, WA (US); Lloyd Fladgard, Kingston, WA (US)

(73) Assignee: Pacific International Tool & Shear, Ltd., Kingston, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/935,208

(22) Filed: Aug. 21, 2001

(65) Prior Publication Data

US 2002/0053177 A1 May 9, 2002

Related U.S. Application Data

(63) Continuation of application No. 09/074,809, filed on May 7, 1998, now Pat. No. 6,276,107.

(51) Int. Cl.[7] ..... E04D 1/00

(52) U.S. Cl. ..... 52/554; 52/313; 52/314; 52/316; 52/555; 52/559; 52/558; 52/748.1; 52/748.11; 52/745.19

(58) Field of Search ..... 52/313, 314, 316, 52/554, 555, 558, 559, 745.19, 748.1, 748.11

(56) References Cited

U.S. PATENT DOCUMENTS

| | | | |
|---|---|---|---|
| 1,447,567 | A | 3/1923 | Overbury |
| 1,732,403 | A | 10/1929 | Harris et al. |
| 1,959,960 | A | 5/1934 | Magrath |
| 2,171,010 | A | 8/1939 | Schuetz et al. |

(List continued on next page.)

OTHER PUBLICATIONS

International Search Report; WO 99/57392 (Published Nov. 11, 1999). Pacific International Tool & Shear, Ltd.

*Primary Examiner*—Carl D. Friedman
*Assistant Examiner*—Dennis L. Dorsey
(74) *Attorney, Agent, or Firm*—Perkins Coie LLP

(57) ABSTRACT

Unitary modular shake panels and methods for making and using such shake panels. In one aspect of the invention, a unitary modular shake panel includes an interconnecting section composed of a siding material and several integral shake sections projecting from the interconnecting section. The panel preferably has a quadrilateral shape with first and second edges along a longitudinal dimension that are separated from each other by a width of the panel along a transverse dimension. Additionally, the shake sections are separated from one another by slots extending from the second edge to an intermediate width in the panel. In a preferred embodiment, the panel is composed of a unitary piece of fiber-cement siding with a simulated wood grain running along the transverse dimension. The interconnecting section is preferably a web portion of the fiber-cement siding piece, and the shake sections are different portions of the same fiber-cement siding piece defined by the slots extending in the transverse dimension from the web portion to the second edge of the panel. Modular shake panels in accordance with the invention may be made using several different processes. In one embodiment, for example, a unitary modular shake panel is manufactured by the cutting planks from a sheet of siding material, and then forming slots in the panel to define the web portion and the shake sections. The planks are preferably cut from the sheet in a direction transverse to a wood grain on the surface of the sheet. The slots are preferably cut in the planks in the direction of the wood grain from a longitudinal edge to an intermediate depth within the plank.

11 Claims, 5 Drawing Sheets

U.S. PATENT DOCUMENTS

| | | | | | |
|---|---|---|---|---|---|
| 2,174,098 | A | | 9/1939 | Stein | |
| 2,187,203 | A | | 1/1940 | Johnston | |
| 2,199,760 | A | | 5/1940 | Schuetz | |
| 3,899,344 | A | * | 8/1975 | Jakel | 106/99 |
| 3,927,501 | A | | 12/1975 | Allen et al. | |
| 4,015,391 | A | | 4/1977 | Epstein et al. | |
| 4,288,959 | A | | 9/1981 | Murdock | |
| 4,366,197 | A | | 12/1982 | Hanlon et al. | |
| 4,598,522 | A | * | 7/1986 | Hoofe, III | 52/555 |
| 4,982,541 | A | * | 1/1991 | Winter, IV | 52/303 |
| 5,295,339 | A | * | 3/1994 | Manner | 52/518 |
| 5,501,056 | A | | 3/1996 | Hannah et al. | |
| 5,993,303 | A | | 11/1999 | Fladgard et al. | |
| 6,067,766 | A | * | 5/2000 | Badke | 52/518 |
| 6,336,303 | B1 | * | 1/2002 | Vanderman et al. | 52/520 |

* cited by examiner

UNITARY MODULAR SHAKE-SIDING PANELS, AND METHODS FOR MAKING AND USING SUCH SHAKE-SIDING PANELS

CROSS-REFERENCE TO PRIOR APPLICATION

This is a continuation of application Ser. No. 09/074,809, filed on May 7, 1998, now U.S. Pat. No. 6,276,107, to which a claim for priority is made.

TECHNICAL FIELD

The present invention generally relates to exterior siding materials for use on exterior walls of houses and other structures. More particularly, the invention is directed toward unitary, modular shake-siding panels composed of fiber-cement siding or other suitable siding materials.

BACKGROUND OF THE INVENTION

The exterior walls of houses and other structures are often protected and decorated with a variety of exterior siding products typically made from wood, vinyl, aluminum, stucco or fiber-cement. Additionally, wood and fiber-cement siding products are generally planks, panels or shakes that are "hung" on plywood or composite walls.

Exterior siding shakes are popular products for protecting and enhancing the exterior appearance of homes, offices and other structures. Exterior siding shakes are typically small, rectilinear pieces of cedar or fiber-cement siding. Cedar siding shakes are generally formed by splitting a cedar block along the grain, and fiber-cement siding shakes are generally formed by cross-cutting a plank of fiber-cement siding having a width corresponding to the width of the individual shakes. Although both cedar and fiber-cement siding shakes are generally rectilinear, the bottom edge of the shakes can be trimmed to different shapes for decorative effect. The bottom edge of the shakes, for example, can be scalloped, triangular, square or a modified square with rounded corners.

To install shake siding, a large number of shakes are individually attached to an exterior wall of a structure using nails, staples or other suitable fasteners. Each shake usually abuts an adjacent shake to form a horizontal row of shakes, and each row of shakes overlaps a portion of an immediately underlying row of shakes. For example, a first row of shakes is attached to the bottom of the wall, and then each successive row overlaps the top portion of the immediate underlying row. As such, each shake is generally laterally offset from the shakes in the immediately underlying row so that the shakes in one row span across the abutting edges of the shakes in the immediate underlying row.

One concern of wood siding shakes is that wood has several disadvantages in exterior siding applications. Wood siding, for example, may be undesirable in dry climates or in areas subject to brush fires because it is highly flammable. In humid climates, such as Florida, the wood siding shakes are also generally undesirable because they absorb moisture and may warp or crack. Such warping or cracking may not only destroy the aesthetic beauty of the siding, but it may also allow water to damage the underlying wall. Additionally, wood siding shakes are also undesirable in many other applications because insects infest the siding and other structural components of the structure.

Another concern with conventional siding shakes made from cedar or fiber-cement siding is that it is time consuming to individually attach each shake to a wall. Moreover, additional time is required to individually trim certain shakes to fit in irregular areas on the wall, such as edges and corners. Thus, installing conventional siding shakes requires an extensive amount of labor and time.

To reduce the installation time of installing individual shakes, a particular cedar shake panel has been developed that allows a number of individual shakes to be hung contemporaneously. The particular cedar shake panels have a plurality of individual shakes attached to a thin backing strip composed of plywood. More specifically, the top portion of each individual shake is nailed, stapled, glued or otherwise connected to the plywood backing strip. The particular cedar shake panels reduce the labor required to install the shakes because a single panel covers between two and four linear feet of wall space that would otherwise need to be covered by individual shakes. Such cedar shake panels, however, are significantly more expensive than individual shakes because the shakes are still individually attached to the plywood backing strip by the manufacturer. The plywood backing strip also increases the material costs because it is not required for installing individual shakes. Moreover, the thin plywood backing strip is particularly subject to moisture damage that causes significant warping of the panels and cracking of the shakes. Such cedar shake-siding panels, therefore, are not widely used in humid or wet climates because they are relatively expensive and they have significant long-time performance problems.

SUMMARY OF THE INVENTION

The present invention is directed toward unitary modular shake panels, and methods for making and using such shake panels. In one aspect of the invention, a unitary modular shake panel includes an interconnecting section composed of a siding material and several integral shake sections projecting from the interconnecting section. The panel preferably has a quadrilateral shape with first and second edges along a longitudinal dimension that are separated from each other by a width of the panel along a transverse dimension. Additionally the shake sections are separated from one another by slots extending from the second edge to an intermediate width in the panel. In a preferred embodiment, the panel is composed of a unitary piece of fiber-cement siding with a simulated wood grain running along the transverse dimension. The interconnecting section is preferably a web portion of the fiber-cement siding piece, and the shake sections are different portions of the same fiber-cement siding piece defined by the slots extending in the transverse dimension from the web portion to the second edge of the panel.

Modular shake panels in accordance with the invention may be made using several different processes. In one embodiment, for example, a plurality of unitary modular shake panels are manufactured by the cutting a plurality of planks from a sheet of siding material, and then forming slots in the planks to define the web portion and the shake sections of each panel. The planks are preferably cut from the sheet in a direction transverse to a wood grain on the surface of the sheet. The slots are preferably cut in the planks in the direction of the wood grain from a longitudinal edge to an intermediate depth within the planks.

DETAILED DESCRIPTION OF THE INVENTION

The following description describes unitary modular shake panels, and methods for making and using such shake panels. Although FIGS. 1–6D and the following description set forth numerous specific details of particular embodiments of the invention to provide a thorough understanding for making and using such embodiments, a person skilled in the relevant art will readily recognize that the present invention can be practiced without one or more of the specific details reflected in the embodiments described in the following description.

Figure 1:
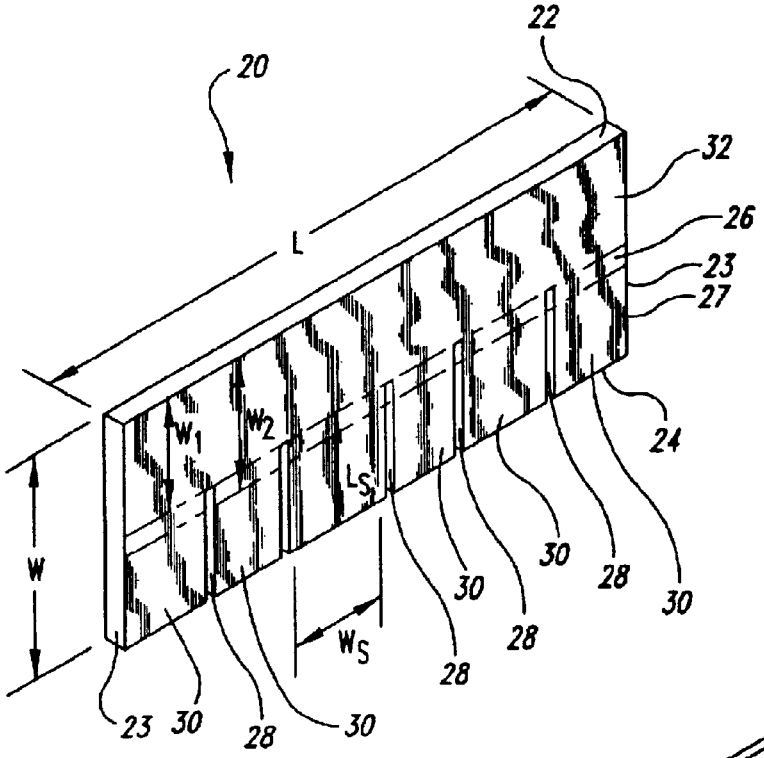
FIG. 1 is an isometric view of a shake-siding panel in accordance with an embodiment of the invention.

FIG. 1 illustrates an embodiment of a unitary modular shake panel 20 having a length L along a longitudinal dimension and a width W along a transverse dimension. The length L of the shake panel 20 is typically 4 feet, but the length can also be 8', 10', 12' or virtually any other length. The width W is typically 16 inches, but the width is typically from 6¼ to 24 inches. The shake panel 20 has side edges 23 separated from each other by the length L, a top edge 22 extending along the longitudinal dimension between the upper ends of the side edges 23, and a bottom edge 24 extending along the longitudinal dimension between the bottom ends of the side edges 23. The top and bottom edges 22 and 24 are preferably substantially parallel to each other and separated by the width W of the panel 20. An overlap region 26 defined by the area between a first intermediate width $W_1$ and a second intermediate width $W_2$ also extends along the longitudinal dimension of the panel 20. For a typical 16 inch wide panel 20, $W_1$ is approximately 9 inches and $W_2$ is approximately 10.5–12 inches to define an overlap region 26 having a width from approximately 1.5 to approximately 3.0 inches.

The particular embodiment of the shake panel 20 shown in FIG. 1 includes a web portion 32 and a plurality of shake sections 30 projecting from the web portion 32. The web portion 32 is defined by a longitudinal portion of the panel between the top edge 22 and the first intermediate dimension $W_1$. The shake sections 30 are defined by transverse portions of the panel 20 between the first intermediate dimension $W_1$ and the bottom edge 24 that are separated from one another by a plurality of slots 28 formed in the panel 20. The slots 28 preferably extend from the lower edge 24 at least for a distance $L_S$ that terminates in the overlapping region 26. The width of the slots 28 is exaggerated in FIGS. 1–5D for the purpose of clarity. In practice, the slots 28 preferably have a width from approximately 0.1 inches to approximately 0.25 inches. The shake sections 30 accordingly have widths $W_S$ corresponding to the distance between slots 28. As explained in more detail below, the shake widths $W_S$ may be regular such that all shakes have the same width $W_S$, or they may be irregular such that the width $W_S$ is different for at least some of the shakes.

The unitary modular shake panels 20 can be made from many suitable siding materials in which the web portion 32 and the shake sections 30 are integrally formed from the same piece of siding material. In a preferred embodiment, the-shake panels 20 are pieces of fiber-cement siding having a simulated wood grain 27 formed on an exterior surface. The shake sections 30 and the web portion 32 of a particular panel 20 are preferably formed from a single piece of fiber-cement siding. Additionally, the slots 28 preferably extend in the direction of the simulated wood grain 27. Thus, the slots 28 and the grain 27 give the appearance of individual shakes to each shake section 30.

Figure 2:
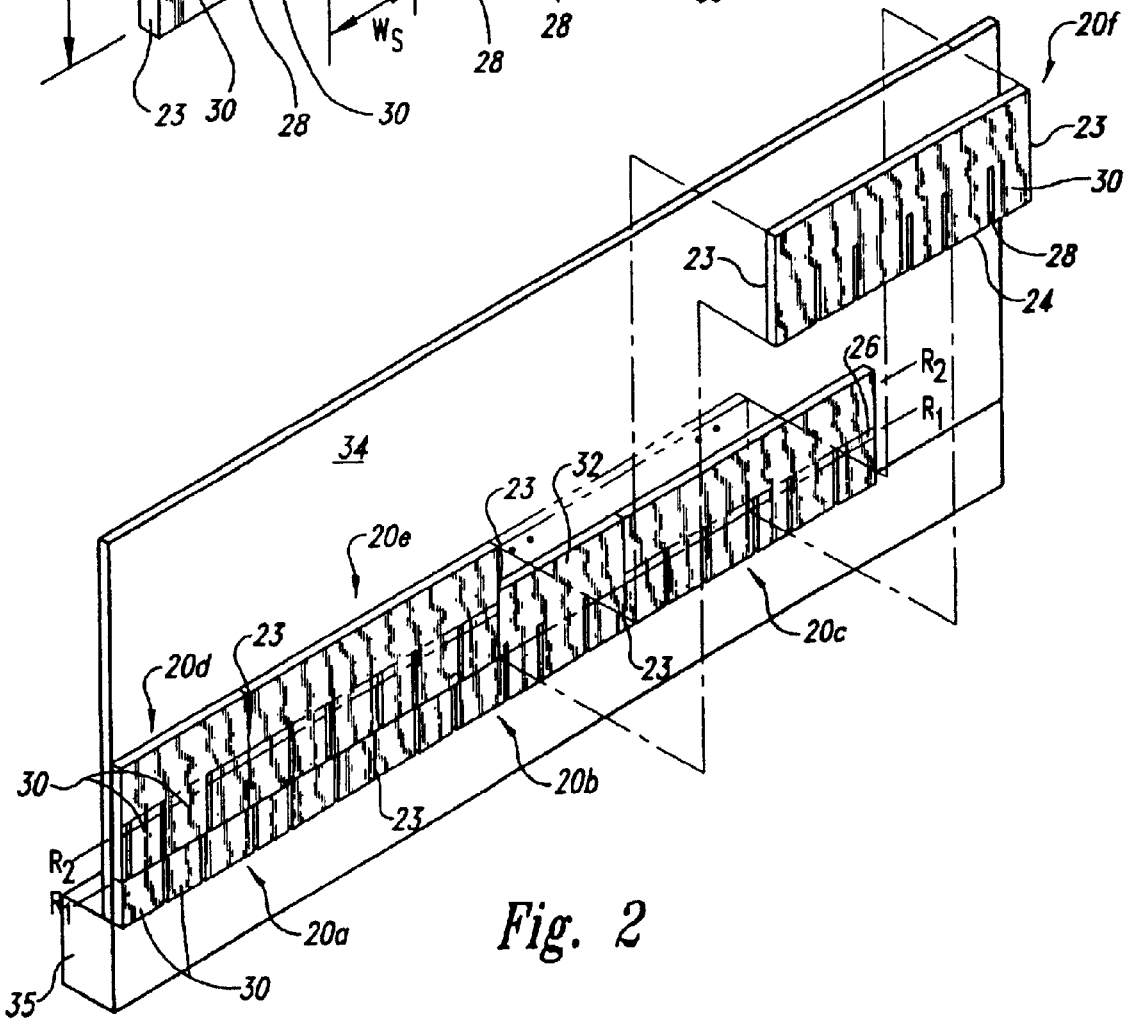
FIG. 2 is an isometric view of a method for installing and using the shake-siding panels shown in FIG. 1 in accordance with an embodiment of the invention.

FIG. 2 illustrates an embodiment of a method for installing and using the modular shake panels 20 on a typical wall 34. A plurality of shake panels 20*a*–20*c* are attached to the wall 34 along a bottom row $R_1$–$R_1$ near a foundation 35 of a structure. The side edges 23 of one panel abut the side edges 23 of an adjacent panel (e.g., shown between panels 20*b* and 20*c*). After installing the panels 20*a*–20*c* along the bottom row $R_1$–$R_1$, another set of shake panels 20*d*–20*f* are installed along a second row $R_2$–$R_2$. The shake sections 30 of the panels 20*d*–20*f* in the second row $R_2$–$R_2$ overlap the web portions 32 and an upper segment of the shake sections 30 of each panel 20*a*–20*c* in the first row $R_1$–$R_1$. More specifically, the bottom edges 24 of the panels 20*d*–20*f* are within the overlap region 26 of the panels 20*a*–20*c*. Additionally, the shake sections 30 of the panels 20*d*–20*f* preferably cover the abutting edges between the panels 20*a*–20*c*.

In some applications, it is necessary to use partial shake panels. In any given installation, for example, the height and/or width of a wall may not be evenly divisible by the full length of the shake panels, or the wall may not be rectilinear. These two factors, combined with the lateral offset of each row relative to the row below it, may result in a space along a particular row of shake panels less than the full-length of a shake panel. In these situations, a partial shake panel (e.g., panel 20*d*) is cut to fit in the available space.

The embodiments of unitary modular shake panels 20 shown in FIGS. 1 and 2 generally reduce the time required to install shake siding compared to individual wood or fiber-cement shakes. As discussed above with reference to the background of the invention, it is time consuming to individually install-each shake. The unitary modular shake panels 20, however, cover 4–12 linear feet wall space with shake sections 30 in a short period of time. Moreover, when the web portion 32 of one panel (e.g., panel 20*a* in FIG. 2) is covered by the shake sections 30 of an overlying panel (e.g., panel 20*e* in FIG. 2), the shake sections of the underlying panel appear to be individual shakes. A row of modular shake panels 20, therefore, may not only be installed in less time than a row of individual conventional shakes, but the row of shake panels 20 provides an aesthetically pleasing "shaked" appearance.

In addition to reducing installation time, when the modular shake-siding panels 20 are composed of fiber-cement siding material, they reduce cracking or warping damage compared to conventional wood shakes or conventional wood-shake panels. As discussed above with reference to the background section, conventional wood shakes and wood-shake panels are flammable and subject to moisture and/or insect damage. Conventional wood-shake panels, for example, are easily damaged by moisture because the thin plywood backing strip is particularly susceptible to delamination or warping in humid or wet environments. In contrast to conventional wood-shake panels, the fiber-cement shake panels 20 are highly resistant to fire, moisture and insects. Thus, the fiber-cement shake panels 20 are expected to last much longer than conventional wood-shake panels with a plywood backing strip or wood shakes.

Figure 3:
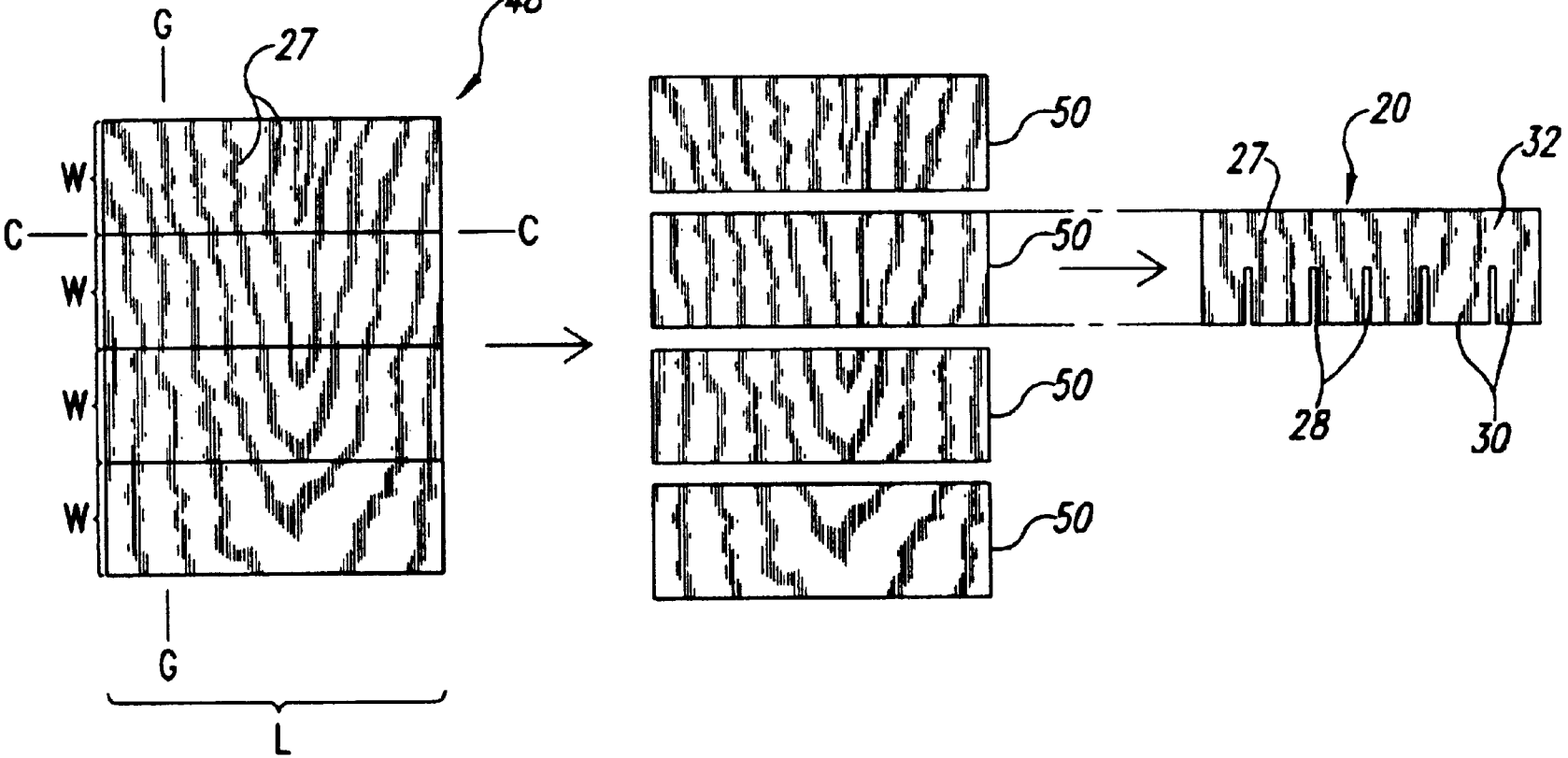
FIG. 3 is a schematic view of a method for manufacturing shake-siding panels in accordance with the invention.

FIG. 3 illustrates one embodiment of a method for manufacturing the unitary modular shake panels 20. At an initial stage of this method, a plurality of siding planks 50 are formed by cross-cutting a sheet 48 of siding material along lines C—C transverse to a grain direction G—G of the grain 27. The sheet 48 preferably has a width equal to the length L of the shake panels 20 and a length evenly divisible by the width W of the shake panels 20. Each cross-cut accordingly forms a unitary plank 50 of siding material having the overall dimensions of a modular shake panel 20. A series of slots 28 are then formed along an edge of each plank 50 to fabricate the shake panels 20 with the shake sections 30 and the web portion 32. The slots 28 are preferably cut into the planks 50 to create a one-piece unitary modular shake panel 20. In other embodiments, however, the slots 28 may be formed in the planks 50 by molding, stamping or other suitable processes.

The planks 50 are preferably cut from a sheet 48 composed of fiber-cement siding material using a large shear having opposing serrated blades that span across the width of the panel 48. Suitable shears, for example, are similar to the Model Nos. SS 100 or SS 110 pneumatic shears manufactured by Pacific International Tool and Shear, and disclosed in U.S. Pat. Nos. 5,570,678 and 5,722,386, which are herein incorporated by reference. The planks 50 may also be cut from the sheet using a high-pressure fluid-jet or an abrasive disk. Suitable high-pressure fluid-jet cutting systems are manufactured by Flow International Corporation of Kent, Wash.

The slots 28 are preferably out in planks 50 composed of fiber-cement siding material using a reciprocating blade shear. For example, suitable reciprocating blade shears are the Model Nos. SS 302 and SS 303 shears also manufactured by Pacific International Tool and Shear of Kingston, Wash., and disclosed in U.S. Pat. No. 5,993,303 entitled "HAND-HELD CUTTING TOOL FOR CUTTING FIBER-CEMENT SIDING," and filed on Mar. 6, 1998, which is herein incorporated by reference. The slots 28 can be also cut in fiber-cement siding planks 50 using high-pressure fluid-jets or abrasive disks.

Figure 4A:
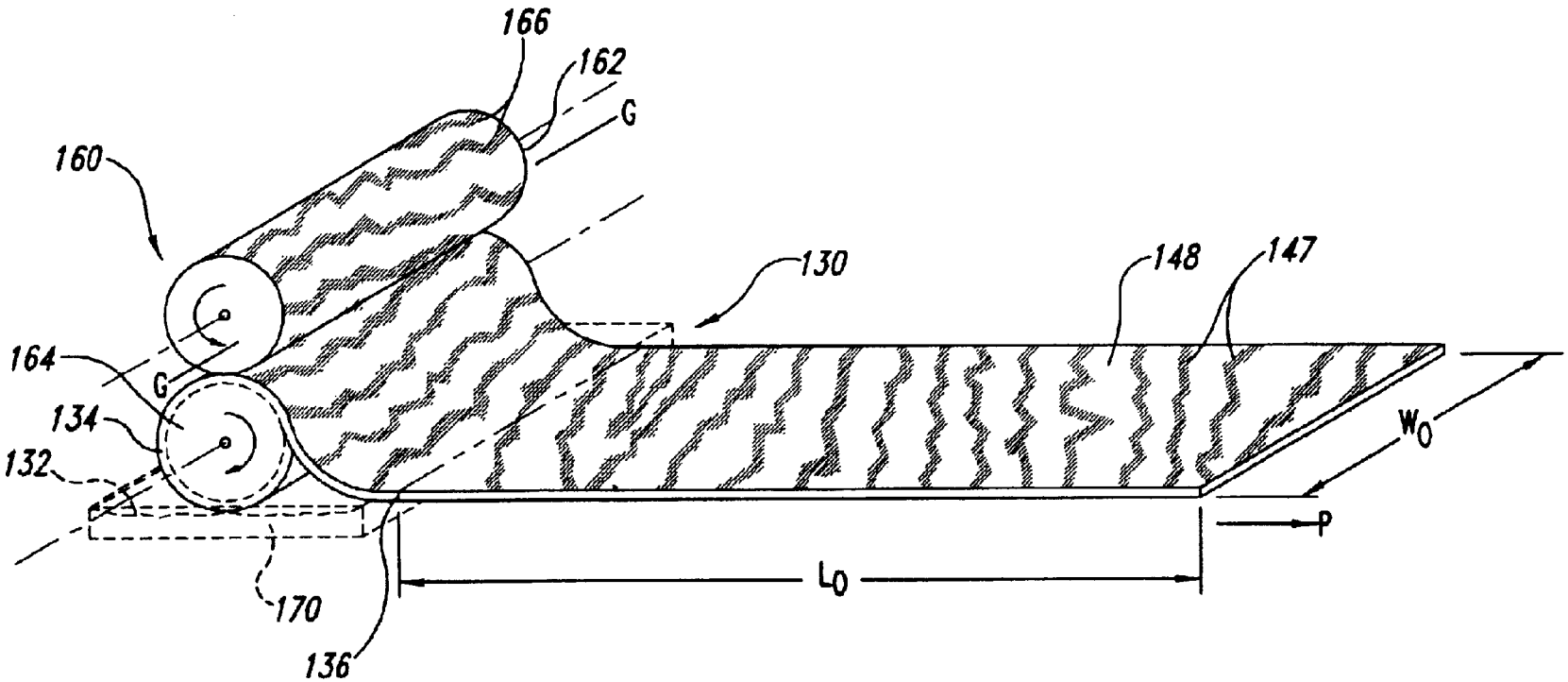
FIG. 4A is a schematic isometric view of a method for manufacturing a sheet of fiber-cement siding material having a transverse running grain.
Figure 4B:
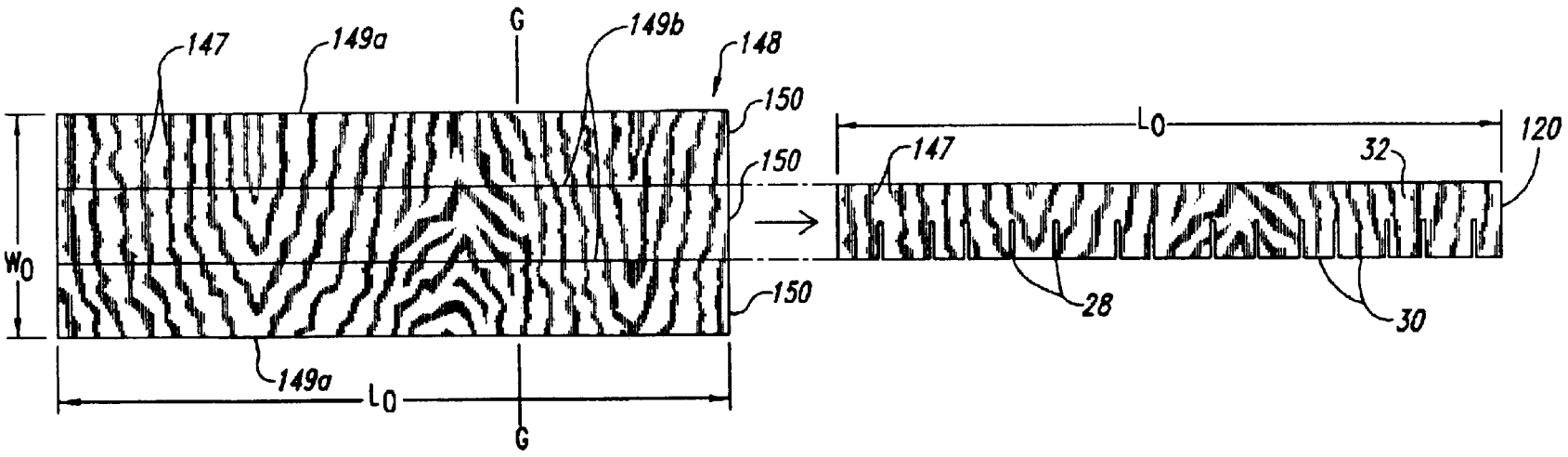
FIG. 4B is a schematic view of another method for manufacturing shake-siding panels from the sheet of fiber-cement siding manufactured according to FIG. 4A in accordance with another embodiment of the invention.

FIGS. 4A and 4B illustrate another embodiment of a method for manufacturing long unitary modular shake panels composed of a fiber-cement siding material. Referring to FIG. 4A, a long sheet 130 of fiber-cement siding material is formed through a roller assembly 160 having a first roller 162 and a second roller 164. The first roller 162 has a grain pattern 166 in which the grain direction G—G extends generally transversely to the travel path "P" of the long sheet 130. The second roller 164 is partially submersed in a container 170 holding a fiber-cement slurry 132. In operation, the second roller 164 rotates through the slurry and picks up a layer 134 of fiber-cement siding material. The first roller 162 rotates with the second roller 164 to press the fiber-cement layer 134 to a desired sheet thickness and to emboss a grain pattern onto the long sheet 130 that runs generally transverse to the length of the long sheet 130. After the long sheet 130 is formed, a water-jet cuts the long sheet 130 along line 136 to form a sheet 148 of fiber-cement siding material with a width $W_O$ and a grain pattern 147 running along the grain direction G—G transverse to a length $L_O$. of the sheet 148. It will be appreciated that forming the sheet 48 (FIG. 3) of fiber-cement siding with a grain 27 extending generally along the length of the sheet 48 is known in the art. Unlike the conventional sheet 48, the fiber-cement siding sheet 148 of FIG. 4A has the grain pattern 147 running in a grain direction G—G transverse to the length of the sheet 148.

Referring to FIG. 4B, another water-jet cutting assembly (not shown) cuts a plurality of long planks 150 from the fiber-cement siding sheet 148. In one particular embodiment, two separate water-jets cut the sheet 148 along lines 149*a* to trim the sides of the sheet 148, and two more water-jets cut the sheet 148 along lines 149*b* to separate the planks 150. Each plank 150 has a portion of the grain pattern 147 extending generally transverse to the length $L_O$. After the planks 150 are formed, a number of slots 28 are cut in the planks 150 to form long modular shake panels 120 with a plurality of shake sections 30 extending from an integral web portion 32.

The particular embodiments of the methods for manufacturing unitary modular shake panels described above with reference to FIGS. 3–4B are economical and fast. As described above with reference to the background of the invention, conventional wood shake-siding panels are manufactured by individually attaching wood shakes to a separate plywood backing strip. Conventional processes for manufacturing wood shake-siding panels, therefore, are inefficient because each shake must be split from a block and then individually attached to the plywood backing member. With the unitary modular shake panels 20 or 120, however, the planks 50 or 150 are simply cut from a sheet of siding material, and then all of the shake sections 30 are quickly formed in the planks 50 and 150 by cutting the slots 28. Moreover, the unitary shake-siding panels 20 and 120 do not require an additional, separate backing member or fasteners to attach individual shakes to such a separate backing member. Thus, compared to conventional wood shake-siding panels, the methods for fabricating the unitary shake-siding panels 20 and 120 are expected to reduce the material and labor costs.

In addition to the advantages described above, the particular embodiment of the method for fabricating the long unitary fiber-cement shake-siding panels 120 is particularly advantageous for saving time in both manufacturing and installing the shake-siding panels 120. For example, compared to cutting planks 50 from a 4'×8' sheet 48 of fiber-cement siding to have a length of 4 feet, the planks 150 may be cut in much longer lengths (e.g., 12 feet). As such, a significant amount of board feet of completed fiber-cement shake-siding panels 120 may be manufactured with simple, long cuts that require less time and labor than making the planks 50. Moreover, because the siding panels 120 are longer than siding panels 20, more linear footage of wall space may be covered by hanging a panel 120 than a panel 20 in about the same time. Thus, the long siding panels 120 are generally expected to also reduce the time and labor required to install fiber-cement siding shakes.

Figure 5A:
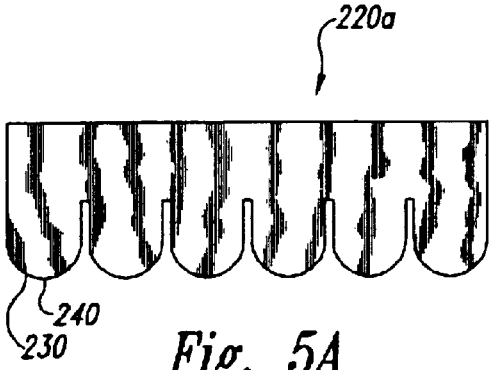
FIGS. 5A–6D are top plan views of several additional embodiments of shake-siding panels illustrating alternate end shapes for the shakes in accordance with other embodiments of the invention.
Figure 6A:
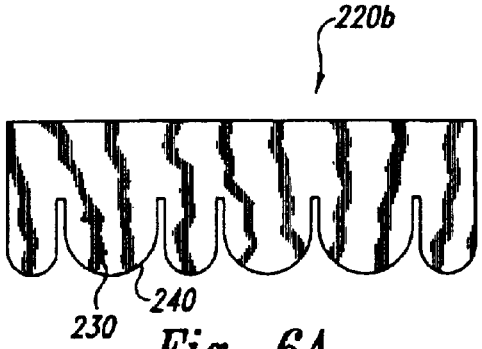
Figure 5B:
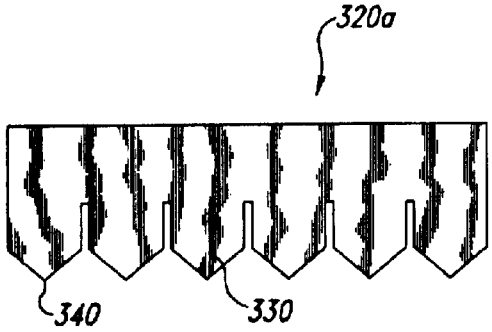
Figure 6B:
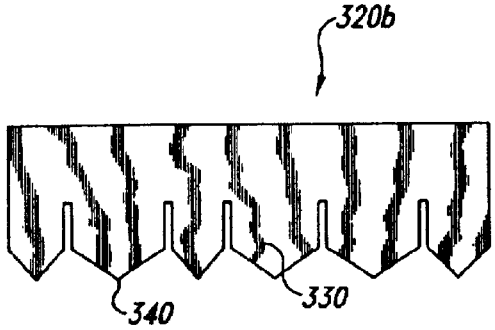
Figure 5C:
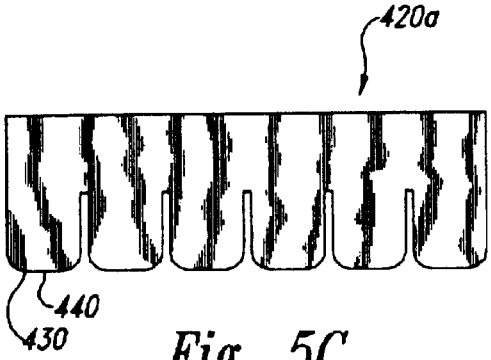
Figure 6C:
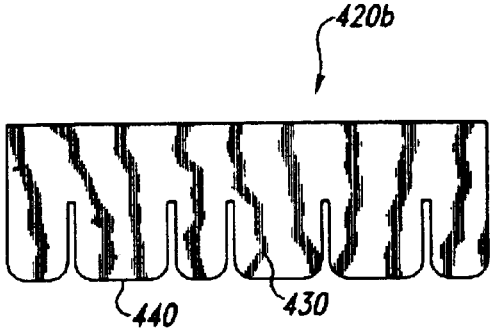
Figure 5D:
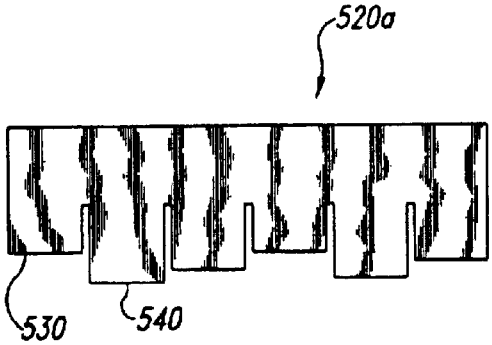
Figure 6D:
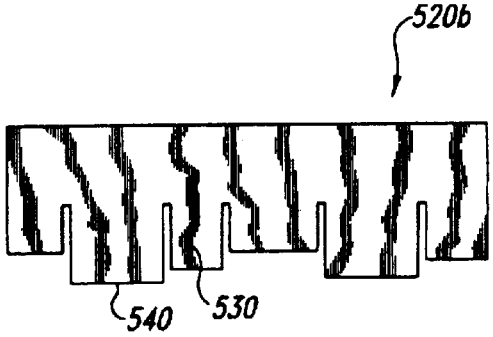

FIGS. 5A–6D illustrate several possible shapes for the ends of the shake sections 30. For example, FIG. 5A illustrates a shake-siding panel 220*a* with regular width shake sections 230 having rounded or scalloped ends 240. FIG. 6A also shows a similar shake panel 220*b* with irregular width shake sections 230 having rounded ends 240. FIG. 58 illustrates a regular panel 320*a* and FIG. 68 illustrates an irregular panel 320*b* that have shake sections 330 with triangular, pointed ends 340. FIG. 5C shows another regular panel 420*a* and FIG. 6C illustrates another irregular panel 420*b* that have shake sectionS 430 with partially rounded ends 440. The non-rectilinear shake ends are useful for enhancing the flexibility in designing the exterior of a house or office. For example, Victorian houses usually use shakes having scalloped ends. FIG. 5D shows yet another regular panel 520*a* and FIG. 60 shows an irregular panel 520*b* That have shake sections 530 with flat ends 540 at different lengths to develop a rough "wood-lodge" appearance.

Although specific embodiments of the present invention are described herein for illustrative purposes, persons skilled in the relevant art will recognize that various equivalent modifications are possible within the scope of the invention. The foregoing description accordingly applies to other unitary modular shake panels, and methods for making and using such shake-panels. In general, therefore, the terms in the following claims should not be construed to limit the invention to the specific embodiments disclosed in the specification. Thus, the invention is not limited by the foregoing description, but instead the scope of the invention is determined entirely by the following claims.

What is claimed is:

1. An exterior shake siding panel for a structure, comprising:

an interconnecting section comprising an exterior surface, a back surface, and one continuous fiber-cement compound from the exterior surface to the back surface, wherein the one fiber-cement compound comprises dement, cellulose fiber and silica; and a plurality of fiber-cement shake sections projecting from the interconnecting section, the shake sections comprising a simulated wood-grain exterior surface and a back surface, and the shake sections being (a) composed of the one fiber-cement compound continuously from the wood-grain exterior surface to the back surface, (b) integral with the interconnecting section, and (c) spaced apart from one another by slots.

2. The exterior shake panel of claim 1 wherein the slots are spaced apart from one another by irregular distances.

3. The exterior shake panel of claim 1 wherein the slots are spaced apart from one another by approximately the same distance.

4. The exterior shake panel of claim 1 wherein the shake sections have different lengths.

5. The exterior shake panel of claim 1 wherein the shake sections have approximately equal lengths.

6. An exterior shake siding panel for a structure, comprising:

a fiber-cement plank composed of one continuous fiber-cement compound comprising cement, cellulose fiber and silica from an exterior surface to a back surface, the plank having a length and a width less than the length, and the exterior surface having wood grain; and a plurality of slots through the plank extending widthwise from a longitudinal edge to an intermediate location in the planK wherein the slots form an interconnecting section and a plurality of shake sections projecting from the interconnecting section, the shake sections being integral with the interconnecting section.

7. The exterior shake panel of claim 6 wherein the slots are spaced apart from one another by irregular distances.

8. The exterior shake panel of claim 6 the slots are spaced apart from one another by approximately the same distance.

9. The exterior shake panel of claim 6 the shake sections have different lengths.

10. The exterior shake panel of claim 6 wherein the shake sections have approximately equal lengths.

11. A unitary shake siding panel for a structure, comprising:

a web portion of a fiber-cement siding piece, the web portion comprising an exterior surface, a back surface, and a continuous unitary fiber-cement compound composed of cement, cellulose fibers and silica between the exterior surface and the back surface; and a plurality of shake sections integral with the web portion and projecting from the web portion, the shake sections comprising an exterior surface with a simulated wood grain and a back surface, and the shake sections being (a) composed of the continuous unitary fiber-cement compound between the exterior surface and the back surface and (b) spaced apart from one another by slots extending from the interconnection section to ends of the shake sections.

* * * * *